US007715058B2

(12) United States Patent
Fraser et al.

(10) Patent No.: US 7,715,058 B2
(45) Date of Patent: May 11, 2010

(54) SYSTEM AND METHOD FOR IMPROVED ENGRAVING OF GRAVURE CYLINDERS BY ADJUSTING ENGRAVING SIGNAL RESPONSIVE TO MOVEMENT OF SHOE POSITION

(75) Inventors: John William Fraser, Dayton, OH (US); Christopher Darrell Winter, Franklin, OH (US)

(73) Assignee: Daetwyler R & D Corp., Miamisburg, OH (US)

( * ) Notice: Subject to any disclaimer, the term of this patent is extended or adjusted under 35 U.S.C. 154(b) by 453 days.

(21) Appl. No.: 11/750,514

(22) Filed: May 18, 2007

(65) Prior Publication Data

US 2008/0285086 A1 Nov. 20, 2008

(51) Int. Cl.
*B41C 1/04* (2006.01)

(52) U.S. Cl. ..... 358/3.29; 358/3.32; 700/193; 700/195

(58) Field of Classification Search ..... 358/3.29, 358/3.32; 700/193, 195, 186; 409/166, 204
See application file for complete search history.

(56) References Cited

U.S. PATENT DOCUMENTS

| | | | | |
|---|---|---|---|---|
| 4,450,486 | A | | 5/1984 | Buechler |
| 5,329,215 | A | | 7/1994 | Fraser et al. |
| 5,424,845 | A | | 6/1995 | Holowko et al. |
| 5,424,846 | A | | 6/1995 | Bornhorst, Jr. et al. |
| 5,438,422 | A | | 8/1995 | Holowko et al. |
| 5,652,659 | A | | 7/1997 | Bornhorst, Jr. et al. |
| 5,816,756 | A | * | 10/1998 | Flohr et al. ..... 409/166 |

* cited by examiner

*Primary Examiner*—Scott A Rogers
(74) *Attorney, Agent, or Firm*—Jacox, Meckstroth & Jenkins

(57) ABSTRACT

An engraver having a shoe sensor system for sensing a movement of the shoe and for adjusting an engraving signal in response thereto.

28 Claims, 10 Drawing Sheets

ADJUSTED ENGRAVER DRIVE SIGNAL
ENGRAVER DRIVE SIGNAL BEFORE ADJUSTMENT
SENSED SHOE POSITION FROM TRANSDUCER
V
TIME
P1
P2
P3
P4

SYSTEM AND METHOD FOR IMPROVED ENGRAVING OF GRAVURE CYLINDERS BY ADJUSTING ENGRAVING SIGNAL RESPONSIVE TO MOVEMENT OF SHOE POSITION

BACKGROUND OF THE INVENTION

1. Field of the Invention

This invention relates to engraving devices, and more particularly to a method and apparatus for detecting surface irregularities and for correct adjustment of engraving in response thereto.

2. Description of the Related Art

Prior art devices of the type shown in U.S. Pat. Nos. 4,450,486; 5,424,846; 5,438,422; 5,424,845; 5,329,215; 5,652,659 typically comprise an engraving head having an engraving device, such as a diamond stylus, and a guide shoe. The guide shoe bore against a surface of a cylinder and provided a reference for the engraving process. An electromagnetic driver mounted within the engraving head caused the engraving device to oscillate into engraving contact with the cylinder as the cylinder rotated about its cylindrical axis, thereby causing either a helical or cylindrical tract of engraved areas or cells to be engraved on the surface of the cylinder.

The cylinders engraved oftentimes had surface irregularities, such as indentations or "bumps" or other artifacts that appeared on the surface of the cylinder. In engraving heads of the prior art, the engraving head had a sliding shoe mount assembly that was very stiff and forced the entire engraving head to follow the surface of the cylinder. The goal of the engraving process is to cut diamond-shaped cells into the surface of a copper cylinder that will be used for gravure printing. The depth of the holes or cells must be controlled with an error less than a fraction of a micron (micro meter). This control must take place while the surface of the cylinder moves radially by hundreds of microns. By having the entire head follow the surface of the cylinder, a cutting diamond stylus is provided with a local reference as to where the cylinder surface is so that it can accurately cut to depth.

A present shoe mount assembly is provided in the engraving machine model number 850-GS-XX available from Max Daetwyler Corporation, the assignee of the present invention. The head has a brass finger about two inches long that flexes in a radial (cylinder radial) direction under the force of a screw. The finger is mounted to the engraving head casting at the bottom and the sliding shoe mounts to the top end of the finger. The top of the finger is supported radially (again with respect to the cylinder) from behind by a fine-threaded screw. The screw adjusts the position of the shoe with respect to the engraving head casting and provides a stiff support from between the shoe and the casting. The result is a stiff, but adjustable, support for the sliding shoe. The effective mass of the engraving head is, in a typical engraver, approximately six kilograms.

In other engraving systems, such as systems provided by Rudolph Hell Company, the engraving head and the shoe diamond is mounted to the tip of a screw threaded into the casting of the engraving head. The axis of the shoe screw is oriented radially with respect to the cylinder surface. Rotating the shoe screw adjusts the relative position of the engraving head casting and thus the position of the cutting diamond relative to the surface of the cylinder. The effective mass of these types of engraving heads is on the order of about two kilograms.

The gravure industry has changed recently and where the surface of the cylinder to be engraved could be seen to be nearly perfect, many customers now want to use much rougher cylinder surfaces. With rougher surfaces, more force is applied to the sliding shoe while following the cylinder surface and the force shows up as change in depth of the engraving. The engraving head and the carriage on which it is mounted have mechanical vibrations that can be excited by the shoe dragging on the cylinder surface. Vibration modes can be excited both radially and tangentially to the cylinder. If a lightly dampened vibration mode is driven by a cylinder surface ripple that happens to fall at the vibration resonance, the resulting resonance vibration buildup can be larger than the original surface ripple. All of this causes the size and/or shape of the engraved cells to be inaccurate.

What is needed, therefore, is a method and apparatus for improving engraving and overcoming the problems associated with surface irregularities.

SUMMARY OF THE INVENTION

In one aspect, one embodiment provides a system and method for reducing the mass that is following the surface of the cylinder and, therefore, the engraved response to cylinder surface irregularities.

In one aspect, this invention comprises an engraver for engraving a cylinder comprising an engraving bed, an engraving head situated on the engraving bed, the engraving head comprising a shoe for engaging a surface of the cylinder and an engraving stylus, an engraving head control for generating an engraving signal for controlling the engraving stylus, a shoe position sensor coupled to the engraving head control, the shoe position sensor sensing a position of the shoe with respect to the engraving head body and generating a shoe position signal in response thereto, the engraving head control receiving the shoe position signal and adjusting the engraving signal in response thereto.

In another aspect, this invention comprises an engraving head for use on an engraver having an engraving bed, a headstock and tailstock for rotatably supporting a cylinder, the engraving head comprising a shoe for engaging a surface of the cylinder, an engraving stylus, an engraving head control for generating an engraving signal for controlling movement of the engraving stylus, and a shoe position sensor coupled to the engraving head control, the shoe position sensor sensing a position of the shoe with respect to the engraving head body and generating a shoe position signal in response thereto, the engraving head control receiving the shoe position signal and adjusting the engraving signal in response thereto.

In still another aspect, this invention comprises a method for engraving a cylinder on an engraver having an engraving head comprising the steps of rotatably mounting the cylinder on the engraver, sensing a movement of a shoe position with respect to the engraving head body and generating a shoe position signal in response thereto, adjusting an engraving signal in response thereto.

Another object of one embodiment is to able customers to use substantially lower quality cylinders, that is, surface cylinders with substantially greater surface irregularities and to improve printing, even though it is done from lower quality cylinders.

Still another advantage is that it may be possible to use lower shoe pressures, which reduces the marking of the engraved surface and coupling less energy into vibration modes in the engraving head and carriage on which the engraving head is mounted.

Another embodiment is that the moving shoe technology is rather simple in design and robust and should enable easier manufacturability with lower precision tooling.

These and other objects and advantages of the invention will be apparent from the following description, the accompanying drawings and the appended claims.

DETAILED DESCRIPTION OF THE PREFERRED EMBODIMENT

Figure 1:
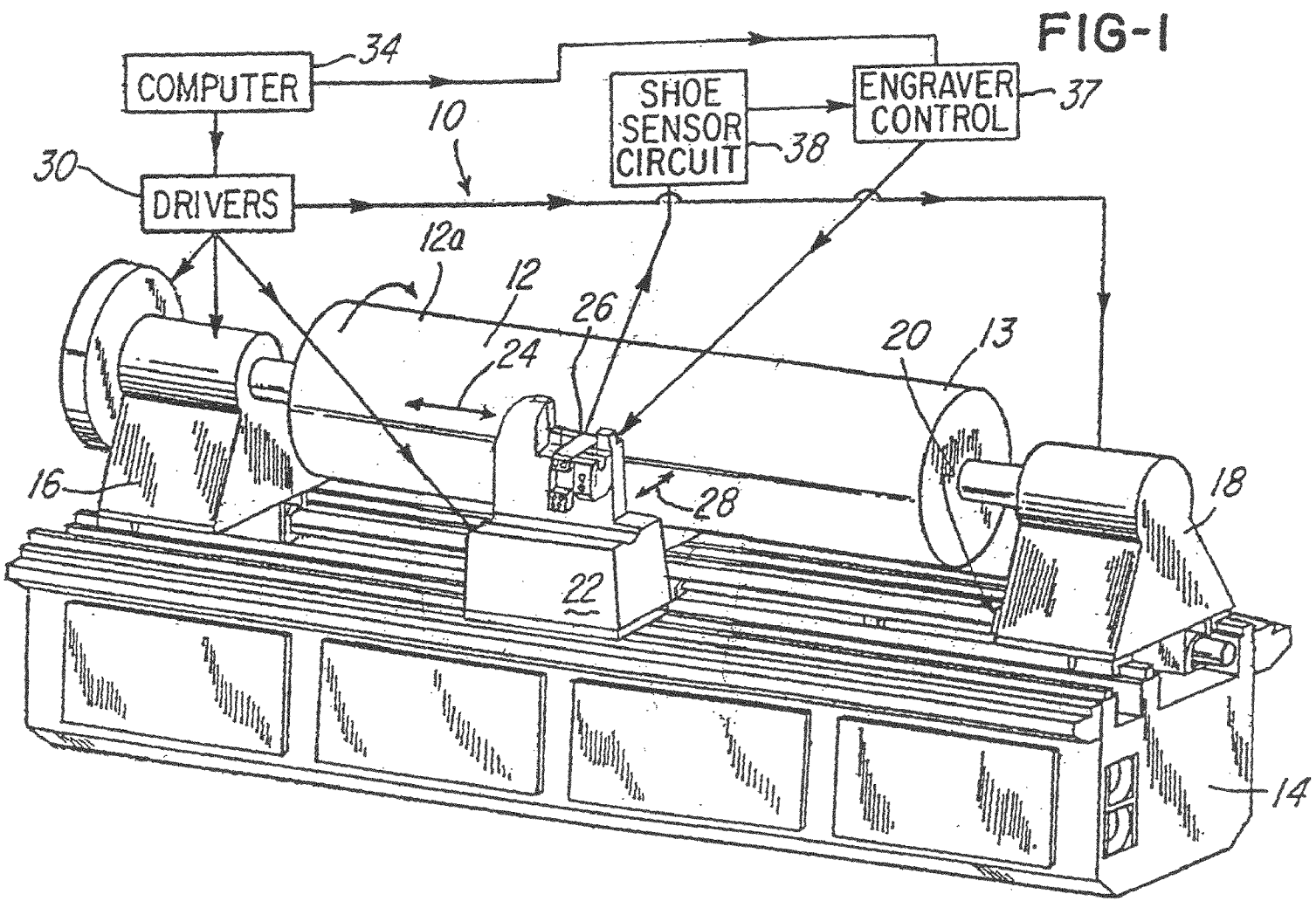
FIG. 1 is a perspective view of an engraving machine including one embodiment of the invention.

FIG. 1 is a general perspective view of a preferred embodiment of an engraver, designated generally as engraver 10.

In the embodiment being described, the engraver 10 is a gravure engraver, but the invention may be suitable for use in other types of engravers, such as laser engravers.

The engraver 10 is a gravure engraver for engraving a surface 12*a* of a cylinder 12 which will subsequently be used to print a predetermined pattern of cells on a substrate. The cylinder 12 will then be placed in a printing machine and in a gravure printing process to thereby print via the gravure printing process on the substrate. The cylinder 12 has the surface 12*a* which has an engravable coating, such as copper.

The engraver 10 comprises a base 14 having a headstock 16 and a tailstock 18 slidably mounted on a bed 20 situated on the base 14. The headstock 16 and tailstock 18 are slidably and adjustably mounted on the bed 20 with suitable bearings and drive train (not shown) such that the headstock 16 and tailstock 18 can rotatably support the cylinder 12 there between. The engraver 10 also comprises a carriage 22 which is slidably mounted on the bed 20 with suitable bearing and drive train (not shown). The carriage 22 may be driven in a direction of double arrow 24 in order to affect engraving as described herein. Notice also that engraver 10 comprises an engraving head 26 which is slidably or moveably mounted on the carriage 22 such that it can be driven towards and away from the cylinder 12 in the direction of double arrow 28 in FIG. 1.

The engraver 10 also comprises a plurality of actuators of drive means or drivers 30 that are capable of rotatably driving the cylinder 12. The drivers 30 comprise suitable motors and drive mechanisms (not shown) for selectively driving carriage 22 and engraving head 26 to engrave the engrave cells into the surface 12*a* of the cylinder 12. If desired, the drivers 30 may also comprise at least one suitable drive motor and drive train (not shown) for driving the headstock 16 and tailstock 18 into and out of engagement with the cylinder 12, thereby eliminating the need for manual adjustment. For example, the drivers 30 may cause the headstock 16 and tailstock 18 to be actuated to a fully retracted position (not shown) or to a cylinder support position shown in FIG. 1. The drivers may be selectively energized to cause the headstock 16 and tailstock 18 to be actuated either independently or simultaneously.

Although, not shown, a single drive motor may be used with a single lead screw (not shown) having reverse threads (not shown) on which either end causes the headstock 16 and tailstock 18 to move simultaneously towards and away from each other as the lead screw is driven. Driving both the headstock 16 and tailstock 18 permits cylinders 12 of varying lengths to be loaded by an overhead crane, for example, whose path is perpendicular to the axis of rotation in the cylinder 12. However, it should be appreciated that a stationary headstock 16 and tailstock 18 may be used when with a driven headstock 16 and tailstock 18, respectively, if, for example, a cylinder loading mechanism (not shown) loads the cylinder by moving in a direction which is generally parallel to the axis of rotation of the engraver.

The drivers 30 may also drive a lead screw (not shown) which is coupled to the carriage in order to affect the driving of the carriage 22 in the direction of double arrow 24. Likewise, drivers 30 may also drive a drive train or lead screw which causes the engraving head 26 to move on the carriage in the direction of double arrow 28 towards and away from the cylinder 12. The engraving head 26, carriage 22 and the driven movement thereof is similar to that shown in U.S. Pat. Nos. 5,438,422, 5,424,845, 5,329,215 and 5,424,846, U.S. Pat. No. 4,450,586 issued to the same assignee as the present application on May 22, 1984; U.S. Pat. No. 4,438,460 issued to the same assignee as the present invention on Mar. 20, 1984; U.S. Pat. No. 4,357,633 issued to the same assignee as the present invention on Nov. 2, 1982; and U.S. Pat. No. 5,329,215 issued to the same assignee as the present invention on Jul. 12, 1994, all of which are incorporated herein by reference and made a part hereof.

Figures 6A, 6B, 6C, 6D, 6E:
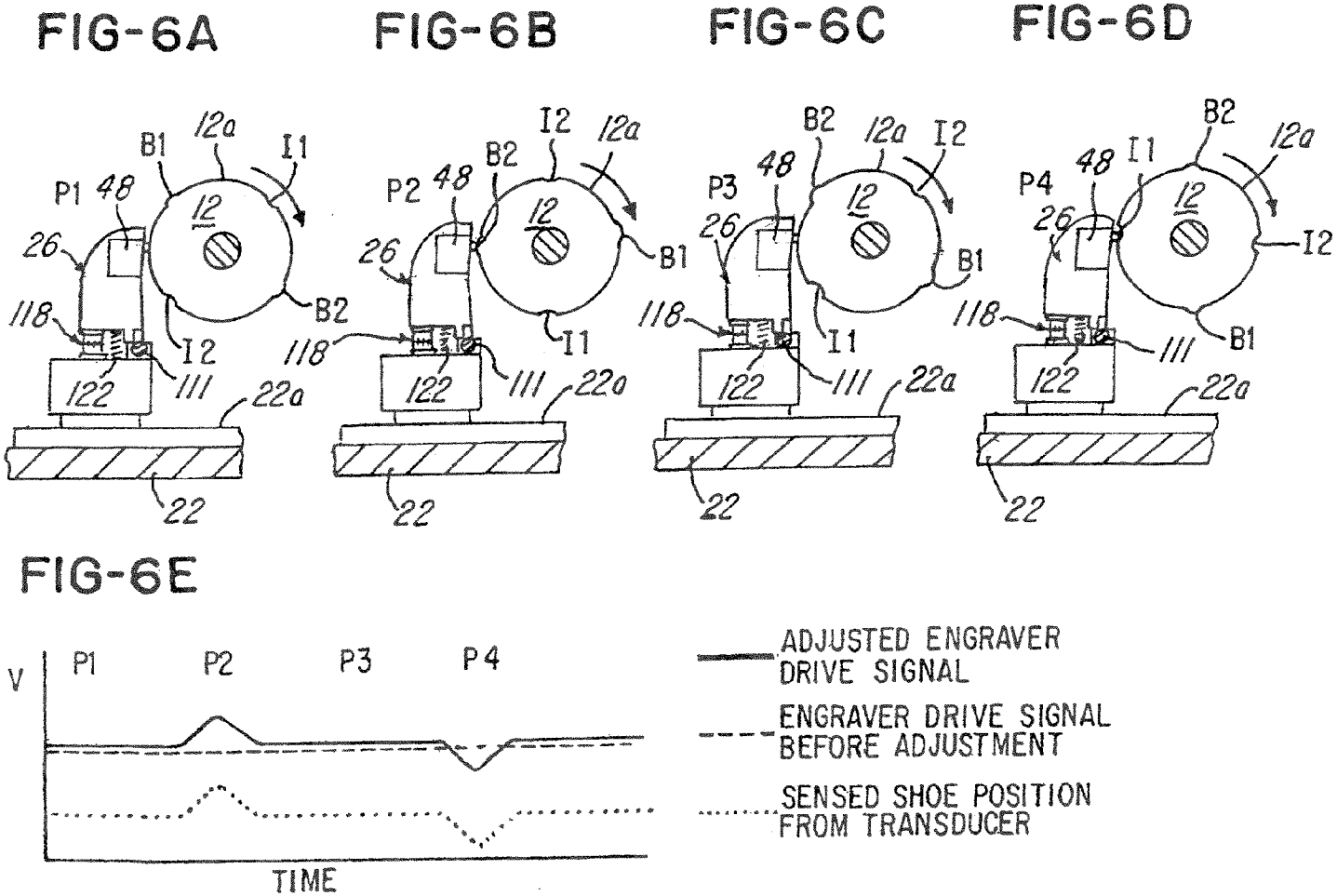
FIGS. 6A-6D are various views illustrating the shoe riding along a surface of a cylinder having imperfections.
FIG. 6E is various diagrams showing an engraving drive signal, an adjusted engraving drive signal and shoe position signal generated by a shoe sensor associated with the shoe support.

The engraver 10 comprises control means, a controller or a computer 34 for controlling the operation of the engraver 10, engraving head 26 and also comprises an engraving control 37 for generating an engraving signal ES (FIG. 6E) corresponding to a selected predetermined pattern to be engraved. The computer 34 also selectively controls all the drive motors, such as drivers 30 mentioned above, in the engraver. The engraving control 37 controls the oscillation or movement of an engraving stylus 40 in response to the engraving control 37.

Notice in FIG. 1 that the system and engraver 10 further comprises a shoe sensor circuit 38 whose structure and operation will be described later herein.

Figure 2:
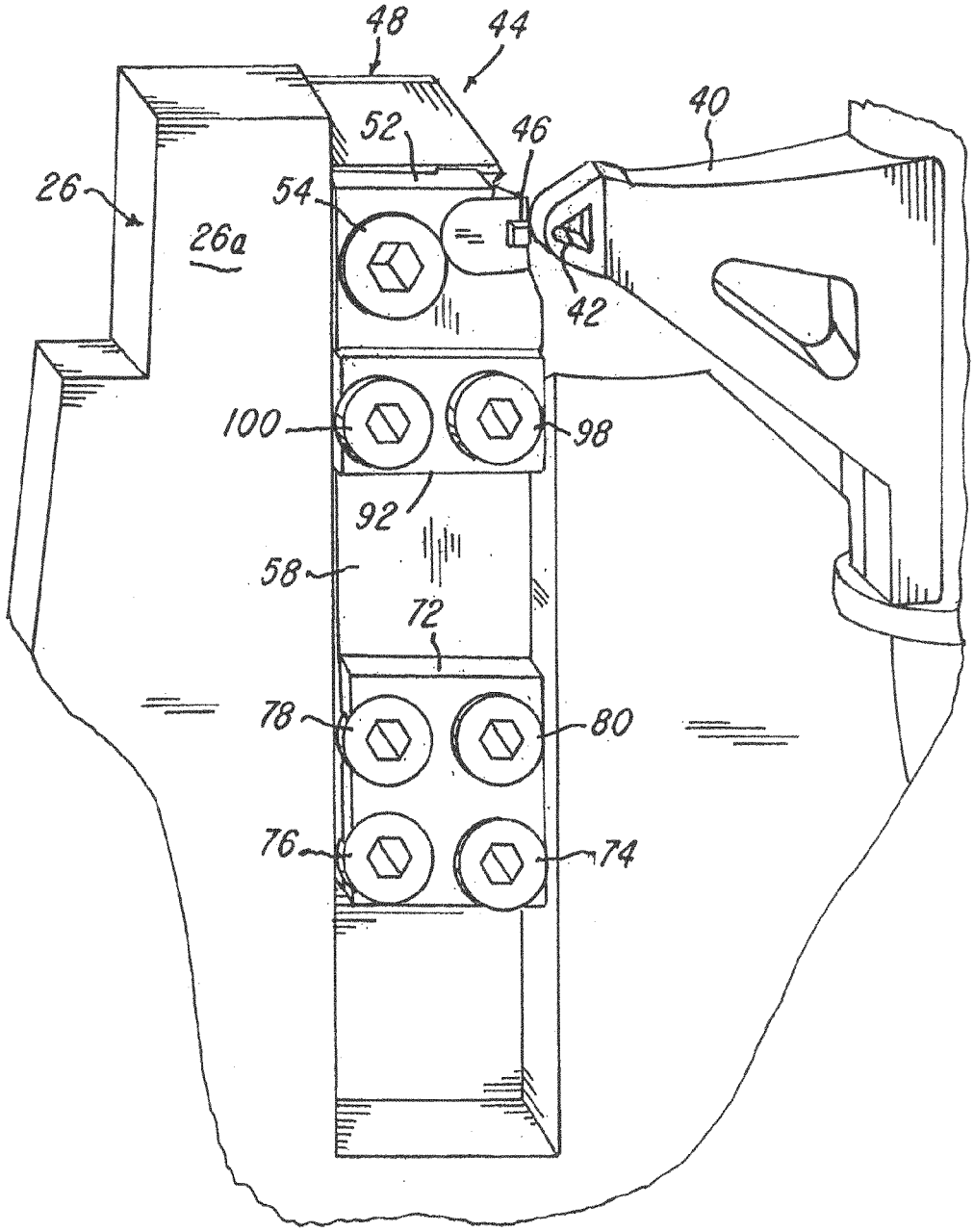
FIG. 2 is a fragmentary view showing a shoe holder relative to a stylus arm and stylus.
Figure 3:
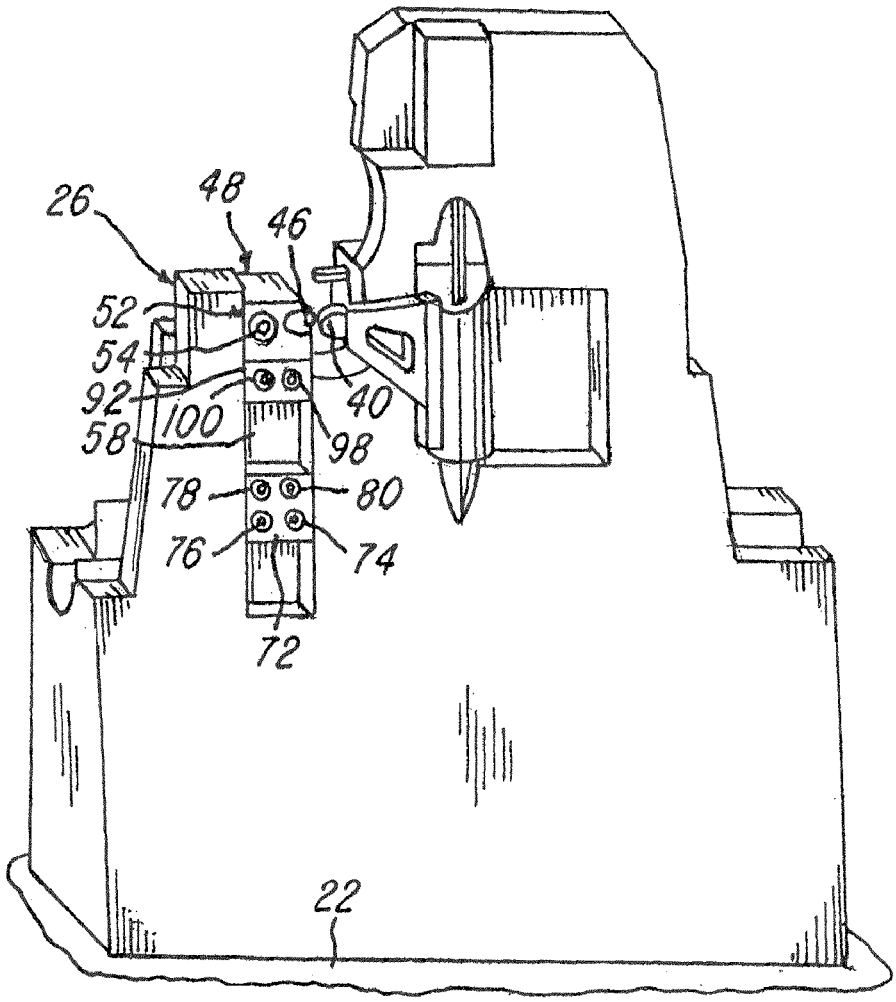
FIG. 3 is a fragmentary view of an engraving head in accordance with one embodiment of the invention.

Referring now to FIG. 2, notice that the engraving head 26 comprises the engraving stylus 40 that holds a cutting tool, such as a diamond stylus 42 in a manner that is conventionally known. The engraving head 26 further comprises a shoe holder assembly 44 that is mounted and secured directly to a body 26*a* of the engraving head 26 as described later herein. The shoe holder assembly 44 comprises a shoe 46 that engages and "rides" along the surface 12*a* of the cylinder 12 as the stylus 42 is caused to oscillate in order to engrave cells (not shown) in the surface 12*a* of the cylinder 12. It should be understood that the shoe assembly 44 is fixably or moveably mounted to the engraving head housing 26*a* in a manner that will now be described relative to FIGS. 2-5.

Figure 5:
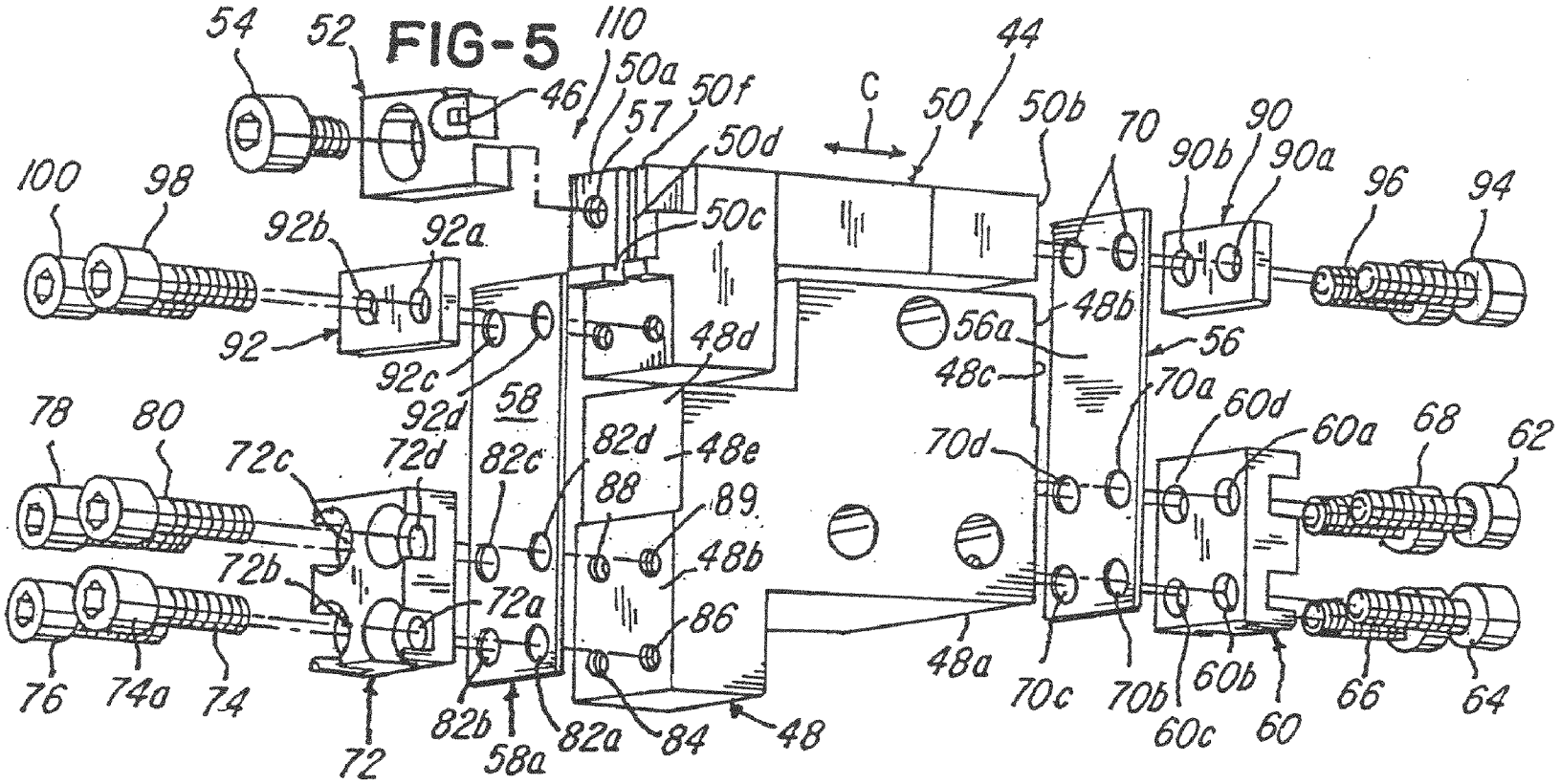
FIG. 5 is an exploded view of the shoe holder shown in FIGS. 2 and 3.

Notice in the exploded view in FIG. 5, the shoe assembly 44 comprises a shoe support 48 onto which a main shoe block or holder 50 is adjustably mounted. Notice that the shoe 46 is integrally secured and mounted to a front face 50*a* (FIG. 5) in shoe block 50 with a conventional machine screw 54 that is received in a threaded aperture 57. Note that the shoe holder 50 has the front face 50*a* and a rear face 50*b* that are coupled or flexibly mounted directly to support 48 with a first spring sheet 56 and second spring sheet 58. The first spring sheet 56 is coupled or secured to a face 48*a* of support 48 with a first mounting block 60 having apertures 60*a*-60*d* for receiving the threaded machine screws 62, 64, 66 and 68 respectively. The first spring sheet 56 comprises apertures 70, 70*a*, 70*b*, 70*c* and 70*d* that also receive the machine screws 94, 96 and 62-68, as shown. The machine screws 62-68 are screwed into the threaded apertures (not shown) in the face 48*a* of support 48.

Likewise, a second block 72 comprises apertures 72*a*, 72*b*, 72*c* and 72*d* for receiving the screws 74, 76, 78 and 80, respectively. The screws 74-80 are received in the apertures 72*a*-72*d* and corresponding apertures 82*a*, 82*b*, 82*c* and 82*d* in spring sheet 58 and threaded into the threaded apertures 84, 86, 88 and 89 as shown. It should be understood that support 48 has surfaces 48*c* and 48*e* that are machined to provide relief areas to allow unobstructed and small motion of the spring sheets 56 and 58 in the direction of double arrow C in FIG. 4.

The shoe block 50 is clamped to the spring sheets 56 and 58 with spacer blocks 90 and 92 that have apertures 90*a*, 90*b* and 92*a*, 92*b*, respectively, that receive the machine screws 94 and 96, 98 and 100, respectfully, as shown. The screws 94-96 are situated through the apertures 90*a* and 90*b* and through apertures 70 and into threaded apertures on the face 50*b*. The screws 98, 100 are situated through apertures 92*a* and 92*b* and through aperture 92*d* and 92*c* and into the threaded openings on the face of block 50 as shown.

Note that a surface 48*a* of support 48 comprises a notched-out or relief area 48*b*. A surface 48*c* provides a stop against which the surface 56*a* of spring sheet 56 can move to stop excessive forward movement of the shoe holder 50 toward the cylinder 12; after the support 48 is mounted to the engraving head housing 26*a* of engraving head 26. The support 48 comprises a notched-out area 48*d*. A surface 48*e* provides a stop to prevent excessive aft movement via spring plate surface 58*a* of the shoe 46 away from the surface 12*a* of cylinder 12. Thus, the surfaces 48*c* and 48*e* prevent the spring sheets 56 and 58 from moving beyond a plane defined by the surfaces 48*c* and 48*e*, thereby permitting the spring sheets 56 and 58 to move closer to the surfaces 48*c* and 48*e*, respectively. This enables control of the movement of the shoe holder 50 relative to the support 48 and shoe 46 toward and away from the surface 12*a* of cylinder 12.

Figure 4:
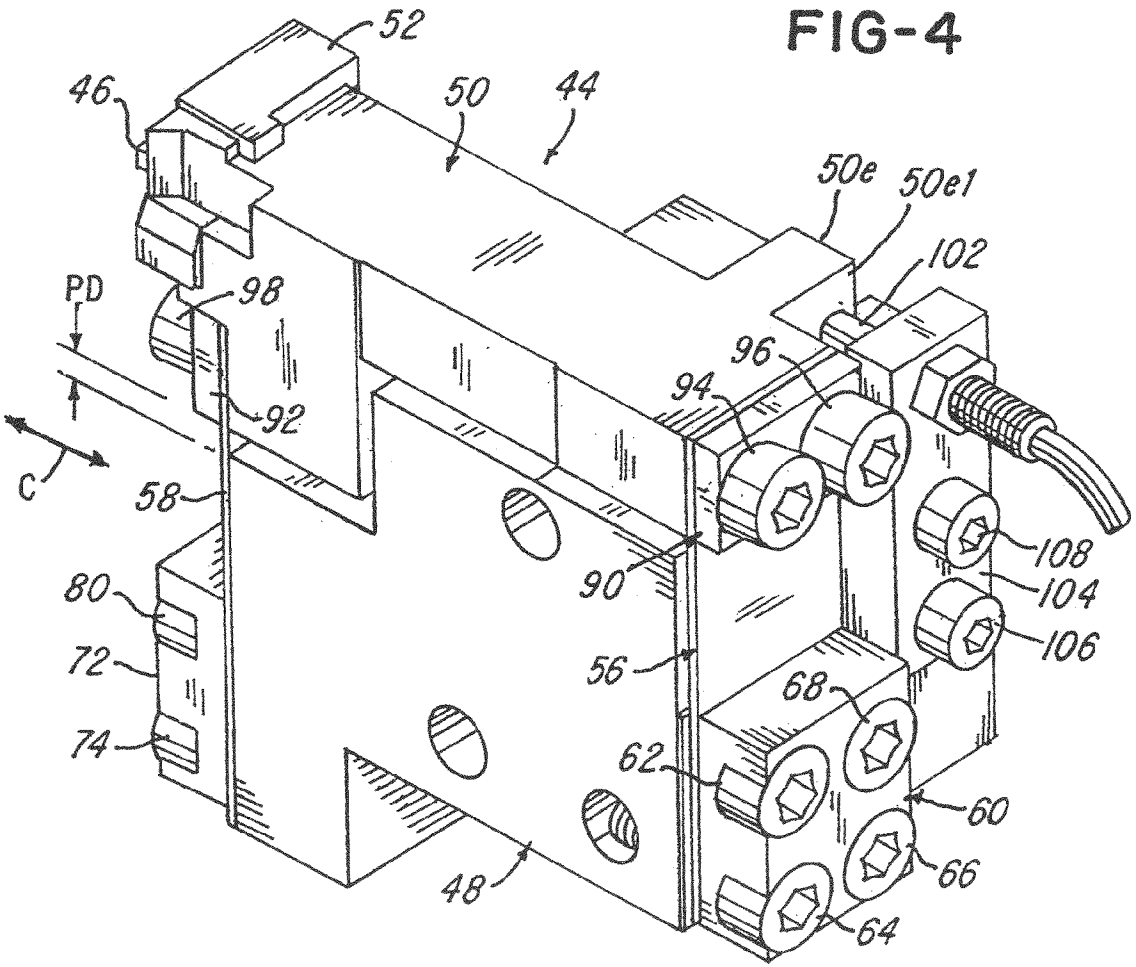
FIG. 4 is an enlarged view of the shoe holder shown in FIGS. 2 and 3.

Note from the assembly illustrated in FIG. 4 that the main shoe block 50 carries and moveably supports the shoe support 52 that holds the shoe diamond and provides linear travel radially relative to the cylinder surface 12*a* because the spring sheets 56 and 58 are mounted in a generally parallel relationship and in a parallelogram-type mount configuration. This enables the required linear travel of the shoe holder 50 relative to the surface 12*a* of the cylinder 12 and relative to the engraving head 26. In one embodiment of the invention, the required range of travel of the shoe holder 50 is on the order of about plus or minus 100 microns (micro meters). The spring mount region or area 110 (FIG. 5) at the front of the holder 50 is dropped vertically to define the area 110 for the shoe diamond plate or shoe support 52. The shoe diamond plate 52 mounts to the front of the shoe holder 50 as shown. Alignment grooves 50*d* and 50*c* are machined into a front face 50*f* of the shoe holder 50 to control the orientation of the shoe diamond plate and therefore the shoe 46.

In one embodiment, such as the embodiment illustrated in FIG. 4, the shoe block 50 is made of a lightweight material, such as aluminum, to keep its mass low. The shoe block 50 comprises a target 50*e* (FIG. 4) for a linear induction or proximity sensor 102. In this regard, notice that the main shoe block 50 comprises the target or projection 50*e* that lies in a plane that is generally parallel to the plane in which the spring sheets 56 and 58 lie. The target 50*e* that cooperates with the linear induction or proximity sensor 102 that senses a movement of the block 50 and generates a sensed shoe position signal (SSP) (FIG. 6) in response thereto. The sensed shoe position signal SSP is received by the engraver control 37 and which may adjust the engraving drive signal ES to provide an adjusted engraving drive signal (AS) in response to the shoe position signal SSP. The operation and function of the sensor and engraving control will be described later herein.

Returning to FIGS. 2-5, note that the vertical spring sheets 56 and 58 are on the order of about 35 millimeters tall and about 12 millimeters wide. The thickness of the spring sheets 56 and 58 is chosen to give the block 50 a proper or predetermined amount of stiffness. The block 50 approximate stiffness should be in the region of about one micron of deflection per Newton of applied force, but a smaller or larger amount of stiffness may be used. Note that spring sheets 56 and 58 are clamped onto their bottom and top quarter of quarters of surfaces 56*a* and 58*a* to enable the sheets 56 and 58 to flex in an elongated S shape. Thus, it should be understood that the spring sheets 56 and 58 are considered to be a "fixed-fixed" type of mount.

As illustrated in FIG. 4, the sensor 102 is mounted in the bracket 104 as shown. The bracket 104 is, in turn, secured to the support 48 with machine screws 106, 108 that are threadably received in threaded apertures (not shown) in the support 48. Notice that after the sensor 102 and bracket 104 are mounted to the block 50, the sensor 102 becomes operatively associated with a surface 50*e*1 of the target 50*e*, as illustrated in FIG. 4. It should be understood that as the shoe holder 50 moves in the direction of double arrow C in FIG. 4, the surface 50*e*1 will move in relation to the sensor 102, which is fixed relative to the support 48. The sensor 102 cooperates with target 50*e* and senses this movement and generates the sensed signal SSP in response thereto. The sensed signal SSP will be received by the engraver control 37 and computer 34 and further processed as described later herein. Thus, the transducer or sensor 102 senses the target 50*e* of the shoe holder 50 and thereby measures a relative position of the shoe holder, and consequently, a position of the shoe 46 relative to the support 48.

Figure 8:
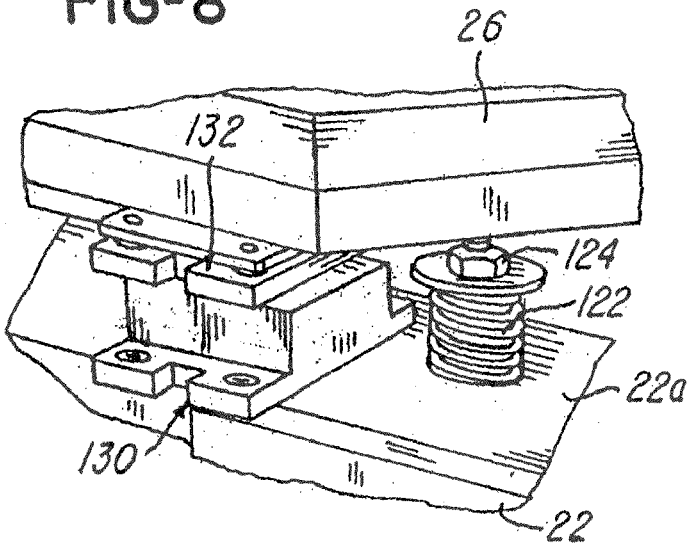
FIG. 8 is a fragmentary view showing the engraving head and damper in a operating position.
Figure 9:
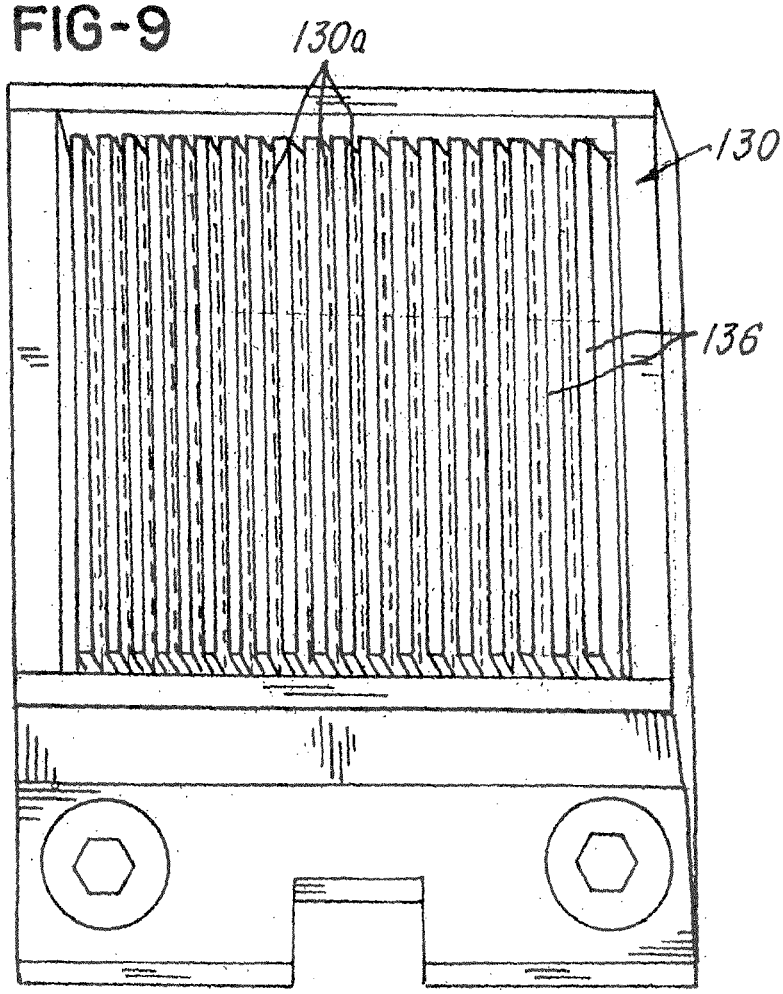
FIG. 9 is an enlarged view of a damper well for receiving fluid.

A damping means or system will now be described relative to FIGS. 7-9. Notice that the engraving head 26 is mounted on a platform axle 111. The axle 111 is mounted on a pair of supports 112 and 114 that are bolted to a surface 22*a* (FIGS. 6A-D) that is integral with or mounted to carriage 22 as shown. The engraving head 26 is mounted on a frame 116, mounted on axle 111, that pivots about an axis E of axle 111, thereby permitting the head 26 to pivot in the direction of double arrow D toward and away from the cylinder 12 as shown.

Mounted between the pivoting engraving head 26, frame 116 and surface 22*a* of the carriage 22 is a damping system or means 118. As best illustrated in FIGS. 7-9, note that the surface 22*a* of carriage 22 comprises an aperture 120 for receiving and supporting a spring 122. An end 122*a* of spring 122 engages a surface 116*a* of the frame 116 onto which the engraving head 26 is mounted. A guide screw or bolt 124 may be received in an aperture or opening 128 defined by the coil of the spring 122 to facilitate maintaining the spring 122 in a generally upright position after the platform or frame 116 is moved from the non-engraving position illustrated in FIG. 7 to the engraving position illustrated in FIG. 8.

Figure 7:
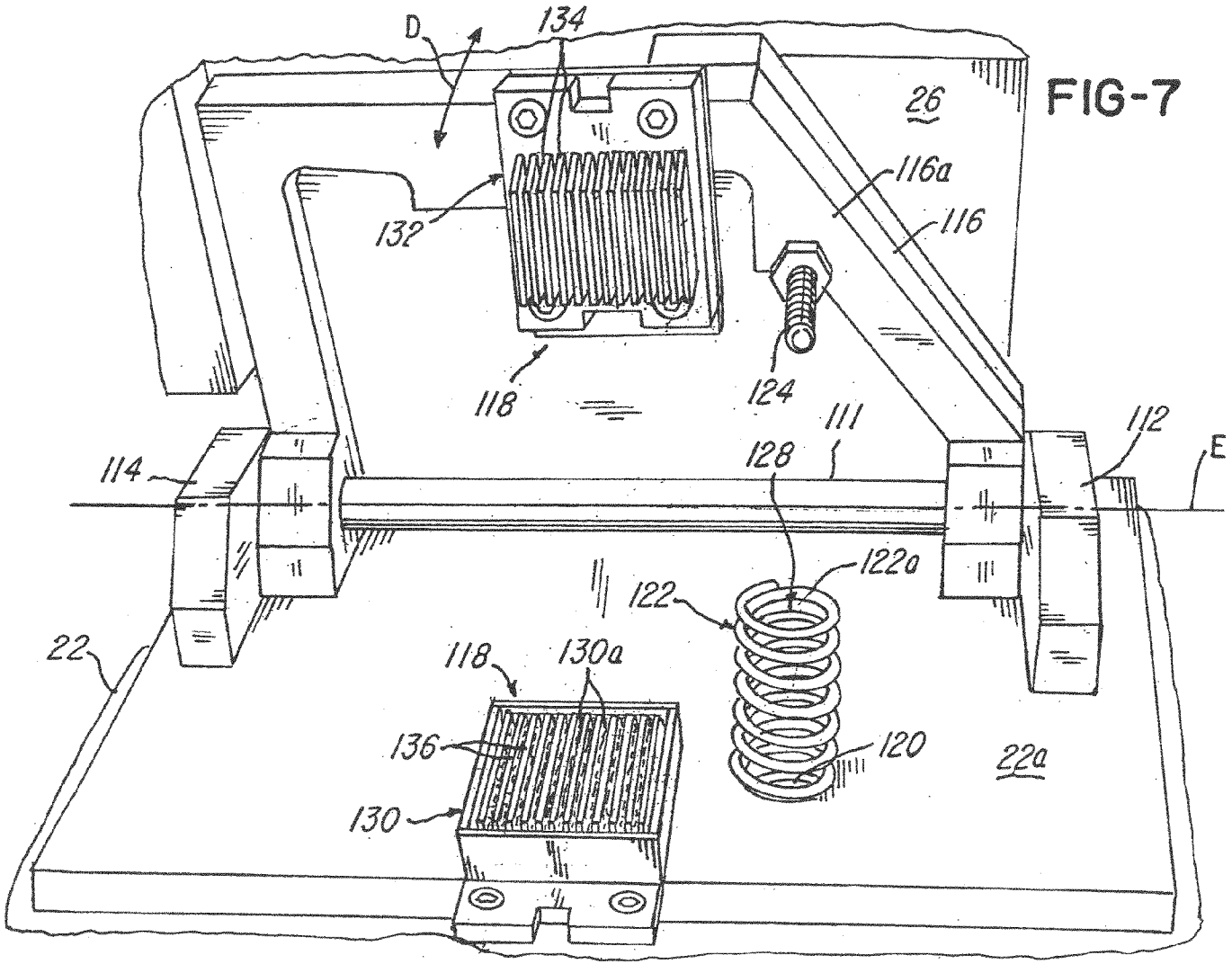
FIG. 7 is a fragmentary view illustrating the pivotal mount of the engraving head and a damper associated therewith.

As illustrated in FIG. 7, notice that the damper 118 comprises a well 130 and a comb 132 having a plurality of combs 134 that are generally parallel. In the embodiment being described, the well 130 receives a viscous fluid, such as silicone oil. It should be understood that when the engraving head 26 is moved to the engraving position illustrated in FIGS. 1 and 8, the combs 134 interleave with a plurality of combs 136 so that there is a large parallel surface areas and small gap between the combs 134 and 136. The volume of area 130*a* toward and away from cylinder 12 and in the well 130 between the combs 136 with the viscous fluid. When the engraving head 26 moves in the direction of double arrow D (FIG. 7) or generally parallel to the planes in which the combs 134 and 136 lie, the viscous liquid or fluid undergoes a shear. The area 130*a*, gap (i.e., distance between combs) and fluid viscosity are chosen to develop a desired viscous damping force, which is defined as Newtons of force developed per unit of velocity (meters per second). The value of the damping is selected to achieve a damped resonance between the mass of the engraving head 26 and a spring coefficient of the shoe mount as dictated by the spring sheets 56 and 58. The damping coefficient or value must also satisfy a compromise that a force developed during cylinder run-out or rotation tracking does not cause excessive shoe movements, which is a correction that can be handled electronically.

Figure 10:
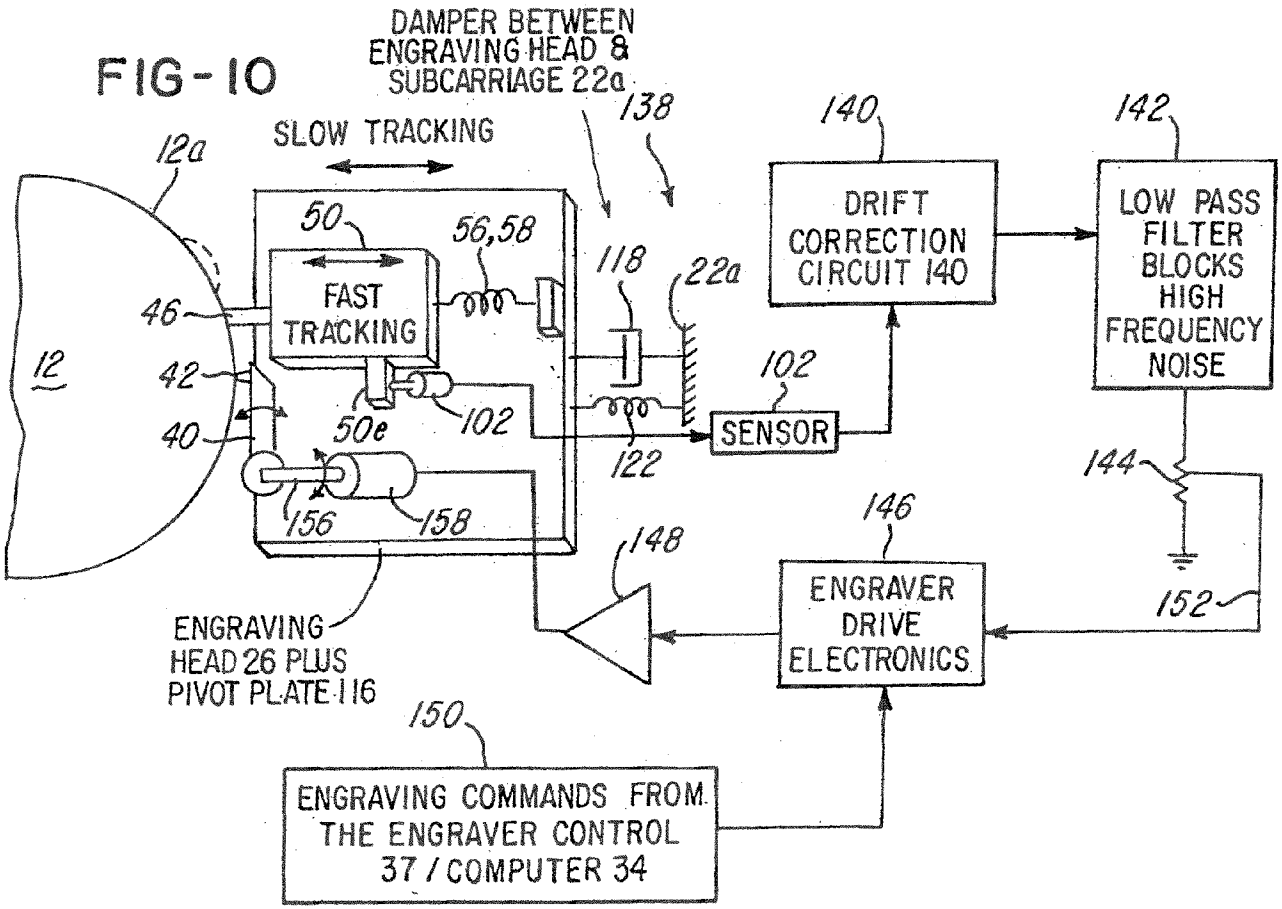
FIG. 10 is a view of a shoe sensor circuit in accordance with one embodiment of the invention.

Referring now to FIG. 10, the engraver control 37, which may be situated on a common card (not shown) as other components (not shown) of the computer 34, comprises the circuit 138 (FIG. 10) having signal electronics are generally characterized in that a relatively small positioned transducer or sensed shoe position (SSP) signal is generated by the sensor 102 and is amplified to a level where it can be sent to the engraving head 26 electronics card (not shown). The amount of amplification is adjusted so that the resulting commanded motion of the cutting stylus 42 generally matches or relates to the motion of the shoe 46 which is affixed to the main shoe block 50. If the sensor 102 has a drift greater than acceptable for engraving, a drift correction circuit 140 may be added to the amplification electronics. A low pass noise filter 142 may also be added to the electronics to reduce or eliminate noise above a predetermined frequency, thereby improving the signal-to-noise ratio of the correction signal.

FIG. 10 illustrates the circuit 138 for performing the correction described herein. A simplified illustration will now be described relative to the views in FIGS. 6A-6D. In the illustration being shown in FIG. 6A, the cylinder 12 has an imperfection, such as a "bump" $B_1$ or $B_2$ or indentation $I_1$ or $I_2$. Note that the movement of the shoe 46 is independent of the stylus 42.

Figure 11:
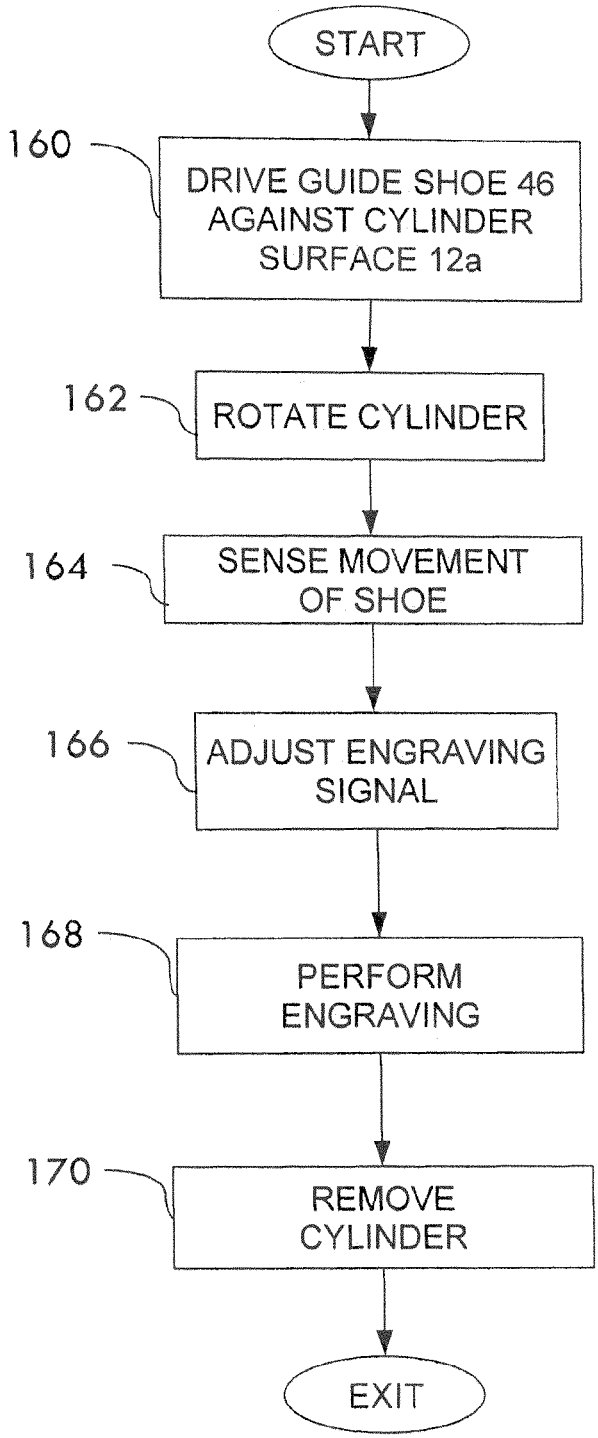
FIG. 11 is a flow diagram illustrating a control algorithm for sensing movement of the shoe and adjusting the engraving signal in accordance with one embodiment of the invention.

As illustrated at blocks 160 and 182 in FIG. 11, the shoe 46 is driven against cylinder 12 and the drives 30 (FIG. 1) rotate cylinder 12. The shoe 46 follows the surface 12*a* of the cylinder 12 and upon encountering the bump $B_1$ or $B_2$, the shoe 46 follows surface 12*a* and moves away from the cylinder 12. If the imperfection was an indentation, such as $I_1$ or $I_2$, for example, the block 50 and shoe 46 move toward an axis of the cylinder 12. In response to the movement of the block 50, the sensor 102 cooperates with the target 50*e* and generates the sensed shoe position signal (SSP) in response thereto at block 164 in FIG. 11. The drift correction circuit 140 may be provided to correct for long term sensor drift at the start of engraving. The low pass noise filter 142 may be provided to reduce or eliminate signal noise above a predetermined kilohertz level in order to improve the correction signal that will be used by the engraving head 26 electronics.

A gain control 144 is provided to set the amount of SSP signal on line 152 which is received by engraver stylus arm electronic control 150 along with engraving command signals received from the computer 34. Thus the SSP signal on line 152 is added to the engraving signal ES from the engrave control computer 34 and the combined adjusted signal AS is sent to the engraver drive electronics 146. The engraving signal AS is received by an amplifier 148 which, in turn, energizes an engraving stylus drive motor 158 which is coupled by a conventional drive linkage 156 to the stylus 42.

Advantageously, the circuit 138 provides means, system and apparatus for generating a correction signal in response to a movement of the shoe 46 by sensing the movement of the shoe 46 and then generating the sensed signal SSP that is used to modify the engraving command signal ES to provide the adjusted signal AS. Thus, accurate adjustments of the stylus 42 can be adjusted to accommodate for imperfections in the surface 12*a* in the cylinder 12.

FIG. 6 illustrates a series of diagrammatic views showing the corresponding movement of the shoe 46 and the corresponding signals AS, ES and SSP.

Referring now to FIG. 11, a general procedure or method of correction will now be described. The procedure starts at block 160 wherein the guide shoe 46 is placed against the cylinder surface 12*a* of cylinder 12. The cylinder 12 is rotated for engraving at block 162, the sensor 102 cooperates with target 50*e* and generates the sensed signal SSP in response to imperfections in the surface 12*a* of cylinder 12 which in turn corresponds directly to the shoe 46 as it follows the surface 12*a*. If necessary, the engraving signal is adjusted (block 166). The circuit 138 causes the engraver control 36 to adjust the engraving drive signal ES in response thereto. Thereafter, the engraver performs engraving (block 168).

Upon completion of engraving, the cylinder 12 is removed (block 170) from the engraver 10 and ultimately used in a printing press for printing on a substrate.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. An engraver for engraving a cylinder comprising:

an engraving bed;

an engraving head situated on said engraving bed, said engraving head comprising a shoe for engaging a surface of the cylinder and an engraving stylus;

an engraving head control for generating an engraving signal for controlling said engraving stylus;

a shoe position sensor coupled to said engraving head control, said shoe position sensor sensing a position of said shoe and generating a shoe position signal in response thereto, said engraving head control receiving said shoe position signal and adjusting said engraving signal in response thereto.

2. The engraver as recited in claim 1 wherein said shoe position sensor senses a position of said shoe relative to said engraving head.

3. The engraver as recited in claim 1 wherein said engraving head comprises a shoe holder and a mount for moveably mounting said shoe holder onto said engraving head.

4. The engraver as recited in claim 3 wherein said mount comprises at least one spring sheet.

5. The engraver as recited in claim 3 wherein said mount comprises a plurality of spring sheets for coupling said shoe holder to said engraving head, said spring sheets being arranged to permit said shoe holder to move independent of said engraving head and in response to an imperfection on said surface of said cylinder.

6. The engraver as recited in claim 1 wherein said shoe position sensor comprises a transducer that cooperates with a target on said shoe holder to generate said engraving signal.

7. The engraver as recited in claim 3 wherein engraver further comprises a damper for damping resonance between the mass of the engraving head and a spring coefficient of said mount.

8. The engraver as recited in claim 3 wherein said mount is a viscous damping mount situated between a bottom of said engraving head and said engraving bed.

9. The engraver as recited in claim 8 wherein said viscous damping mount comprises a plurality of comb plates, at least one of which receives a viscous fluid, said plurality of comb plates cooperating to provide said resonance damping.

10. An engraving head for use on an engraver having an engraving bed, a headstock and tailstock for rotatably supporting a cylinder, said engraving head comprising:

a shoe for engaging a surface of the cylinder;

an engraving stylus;

an engraving head control for generating an engraving signal for controlling movement of said engraving stylus; and a shoe position sensor coupled to said engraving head control, said shoe position sensor sensing a position of said shoe and generating a shoe position signal in response thereto, said engraving head control receiving said shoe position signal and adjusting said engraving signal in response thereto.

11. The engraving head as recited in claim 10 wherein said shoe position sensor senses a change of position of said shoe relative to said engraving head.

12. The engraving head as recited in claim 10 wherein said engraving head comprises a shoe holder and a mount for moveably mounting said shoe holder onto said engraving head.

13. The engraving head as recited in claim 12 wherein said mount comprises at least one spring sheet.

14. The engraving head as recited in claim 12 wherein said mount comprises a plurality of spring sheets for coupling said shoe holder to said engraving head, said plurality of spring sheets being arranged to permit said shoe holder to move independent of said engraving head and in response to an imperfection on said surface of said cylinder.

15. The engraving head as recited in claim 10 wherein said shoe position sensor comprises a transducer mounted on said engraving head, said transducer cooperating with a target on said shoe holder to generate said engraving signal.

16. The engraving head as recited in claim 12 wherein engraving head further comprises a damper for damping resonance between the mass of the engraving head and a spring coefficient of said mount.

17. The engraving head as recited in claim 12 wherein said mount is a viscous damping mount situated between a bottom of said engraving head and said engraving bed.

18. The engraving head as recited in claim 17 wherein said viscous damping mount comprises a plurality of comb plates, at least one of which receives a viscous fluid, said plurality of comb plates cooperating to provide said resonance damping.

19. A method for engraving a cylinder on an engraver having an engraving head comprising the steps of:

rotatably mounting the cylinder on the engraver;

sensing a movement of a shoe position and generating a shoe position signal in response thereto;

adjusting an engraving signal in response thereto.

20. The method as recited in claim 19 wherein said engraving head comprises a stylus, said adjusting step further comprising the step of:

adjusting an engraving signal for controlling movement of said stylus in response to said shoe position signal.

21. The method as recited in claim 19 wherein said sensing step comprises the step of:

sensing a change of position of said shoe relative to said engraving head.

22. The method as recited in claim 19 wherein said method further comprises the step of:

providing an engraving head comprising a shoe holder and a mount for moveably mounting said shoe holder onto said engraving head.

23. The method as recited in claim 22 wherein said mount comprises at least one spring sheet.

24. The method as recited in claim 22 wherein said providing step further comprises the step of:

providing a mount comprising a plurality of spring sheets for coupling said shoe holder to said engraving head, said plurality of spring sheets being arranged to permit said shoe holder to move independent of said engraving head and in response to an imperfection on said surface of said cylinder.

25. The method as recited in claim 19 wherein said sensing step further comprises the step of:

using a transducer mounted on said engraving head, said transducer cooperating with a target on said shoe holder to generate said engraving signal.

26. The method as recited in claim 22 wherein said method further comprises the step of;

damping a resonance between the mass of the engraving head and a spring coefficient of said mount.

27. The method as recited in claim 26 wherein said damping step further comprising the step of:

situating a viscous damping mount between a bottom of said engraving head and said engraving bed.

28. The method as recited in claim 27 wherein said viscous damping mount comprises a plurality of comb plates, at least one of which receives a viscous fluid, said plurality of comb plates cooperating to provide said resonance damping.

* * * * *